US006133195A

United States Patent [19]

Murphy

[11] Patent Number: 6,133,195

[45] Date of Patent: Oct. 17, 2000

[54] PACKAGE SHIPMENT-FACILITATING BUSINESS FORMS AND METHOD OF UTILIZATION THEREOF

[75] Inventor: Sharon M. Murphy, Wilmette, Ill.

[73] Assignee: Moore North America, Inc., Grand Island, N.Y.

[21] Appl. No.: 09/246,958

[22] Filed: Feb. 9, 1999

[51] Int. Cl.[7] ..... B41M 5/124

[52] U.S. Cl. ..... 503/201; 283/81; 428/42.2; 462/18; 462/28; 462/39; 503/226

[58] Field of Search ..... 283/81; 428/42.2; 462/18, 28, 39; 503/201, 226

[56] References Cited

U.S. PATENT DOCUMENTS

| | | | |
|---|---|---|---|
| 3,987,960 | 10/1976 | Gardiner | 229/74 |
| 4,110,502 | 8/1978 | Baer | 428/40 |
| 4,277,089 | 7/1981 | Lokhart | 282/27 R |
| 4,598,935 | 7/1986 | Stewart | 283/81 |
| 4,938,505 | 7/1990 | Gruttemeyer et al. | 282/12 R |
| 5,348,780 | 9/1994 | Boggs et al. | 428/42 |
| 5,395,288 | 3/1995 | Linden et al. | 462/18 |
| 5,397,052 | 3/1995 | Walz | 229/300 |
| 5,419,591 | 5/1995 | Lambert et al. | 283/79 |
| 5,421,778 | 6/1995 | Kouramanis | 462/2 |
| 5,618,064 | 4/1997 | Main | 283/80 |
| 5,704,650 | 1/1998 | Laurash et al. | 283/81 |

OTHER PUBLICATIONS

UPS form produced by Moore U.S.A., Inc., form #01120205; Feb., 1998.

*Primary Examiner*—Bruce H. Hess
*Attorney, Agent, or Firm*—Nixon & Vanderhye P.C.

[57] ABSTRACT

A shipping facilitating business form allows an outgoing address label to be imaged at the same time that a record copy is being imaged, and has both outgoing address label and a tracking label on the same form, and further includes two record copies after the labels are removed. A first paper ply cooperates with a second, composite, ply having a first sheet element and a second release liner underlying the first element, the second ply having a portion extending past the first ply. Pressure sensitive adhesive is provided between the first and second elements, and the extension portion of the second ply comprises tracking labels typically with bar code indicia. Using CF, CB, CF—B and/or self-contained techniques, image transfer is provided between the first ply, to a label portion of the first element, and to the release liner underlying the first element, so that when the label—with variable address indicia imaged on it—is removed both the top ply and second element provide record sheets. Common indicia (e.g. corresponding to a tracking bar code on the tracking label) is provided on the first ply and first and second elements of the second ply. The address label and corresponding tracking label are removed from the form and applied to a package.

20 Claims, 3 Drawing Sheets

PACKAGE SHIPMENT-FACILITATING BUSINESS FORMS AND METHOD OF UTILIZATION THEREOF

BACKGROUND AND SUMMARY OF THE INVENTION

Package delivery services find it important to be able to track packages such as with machine readable codes, while also properly addressing the packages. Utilizing conventional business forms this is typically accomplished by filling out a record sheet having top and bottom plies with image transfer means between the top and bottom plies, and with an extension portion of the bottom ply comprising labels on which bar codes or other tracking indicia are imaged. The top and bottom plies typically include common indicia with the bar code or like tracking indicia imaged on the tracking labels, and with the top ply and the non-label portion of the bottom ply kept as record copies containing variable indicia imaged on the top face of the top ply, and transferred by conventional image transfer coatings to the top face of the underlying second ply. The utilization of such a form requires the user to also fill out a separate address label since both an address label and a tracking label need to be provided on the package. This results in extra work and also the possibility that the tracking and address labels may be inadvertently mismatched.

According to the present invention a shipping facilitating business Form, and a method of using such a form, for package delivery, are provided which overcome the problems associated with the extra work and possibility for mismatching associated with the use of conventional forms. According to the present invention it is possible to prepare the outgoing label at the same time that indicia is being imaged on the record form, and since a corresponding (side-by-side) address label and tracking label are provided, the possibility of mismatching the address label and the tracking label is greatly reduced, and in fact minimized. The invention utilizes as the second ply one with the capability of both providing a label, and transferring the indicia imaged on the label to the underlying release liner which then serves as a second record ply. Such labels are known per se (U.S. Pat. No. 4,277,089 and 5,397,052 being two of many examples), and are readily commercially available.

According to one aspect of the present invention a shipping facilitating business form is provided comprising the following components: A first paper ply comprising a top face containing non-variable indicia and for receipt of variable indicia thereon, and a bottom face, and having a first length. A second, composite, ply having a first sheet element, and a second sheet element underlying the first element, each element having a top face and a bottom face, and the second ply having a second length, greater than the first length. The first ply overlying the second ply with the bottom face of the first ply contacting the top face of the first element at an overlaid portion of the second ply, and with an extension portion of the second ply extending past the length of the first ply so that the extension portion of the first element of the second ply is substantially uncovered by the first ply. First image transfer means operating between the first ply bottom face and the overlaid portion of the first element top face for transferring indicia imaged on the first ply top face to the overlaid portion of the first element top face. The second sheet element comprising at least in part an adhesive release liner. A first plurality of labels formed from the first element in the overlaid portion thereof, and a separate second plurality of labels formed in the extension portion thereof. Pressure sensitive adhesive between the first and second elements for removably holding the first element to the second element, but allowing removal of a label of the first element from the second element with the adhesive on the first element label. And, second image transfer means operating between the first element bottom face and the second element top face where overlaid by the first ply for transferring indicia imaged on the first ply top face to the second element top face and remaining on the second element top face after removal of a label of the first element.

Preferably each of the first plurality of labels corresponds to a remaining portion of the first element and to one of the second plurality of labels. The business form further comprises common indicia imaged on each of the first plurality of labels and its corresponding label of the second plurality of labels, and on the first element on a remaining portion thereof corresponding to the label of the first plurality of labels. Preferably the first ply has corresponding portions to each of the first element plurality of labels, and common indicia is also preferably provided on the corresponding portions of the first ply. The common indicia typically comprises a tracking number. The tracking number may be provided in human readable form, but on the top face of each of the second plurality of labels is in at least bar code form.

Each label of the first plurality of labels is preferably side-by-side with its corresponding label of the second plurality of labels, and by removing the first label and its corresponding second label in sequence before removing any other labels from the form, the possibility of erroneous mismatching of address and tracking labels is minimized. The form further comprises variable address indicia imaged on the first ply top face, and transferred by the first and second image transfer means to a label of the first element top face, and the second element top face underlying the label. The form may also comprise other package delivery relevant indicia imaged on the first ply top face at a portion thereof not overlying the label, and transferred by the first transfer means from the first ply to the first element top face remote from, but corresponding to, a label of the first plurality of labels.

The first and second image transfer means may comprise any conventional image transferring structures, such as carbon paper, carbonless coatings, or any other conventional technique or product. In one exemplary form of the invention, the first image transfer means comprises a CB first ply and a CF first element of the second ply, and the second image transfer means comprises a self-contained coating on the second element top face. In another form of the invention the first and second image transfer means comprise a CB first ply, a CFB first element of the second ply, and CF second element of the second ply. The second element of the second ply may be substantially wholly a release liner.

According to another aspect of the present invention of method of using a business form as described above is provided comprising the following steps: (a) Imaging variable address indicia on the top face of the first ply which transfers to a first label of the first plurality of labels underlying the first ply. (b) Removing the first label from the second element and pressing the pressure sensitive adhesive on the bottom face thereof onto a package. (c) Removing the label of the second plurality of labels corresponding to the first label from the second element and pressing the pressure sensitive adhesive thereof onto the same package as in (b). And, (d) retaining the second element as a record copy.

In the practice of the method, (a)–(c) are repeated for each label of the first and second plurality of labels, with each label of the first plurality of labels and its corresponding label from the second plurality of labels being removed from the form and applied to a package before any other labels are removed. Typically the common indicia includes bar code indicia on the labels of the second plurality of labels, and the method further comprises the step of using the bar code indicia to track the package. The method also typically further comprises the step of retaining the first ply as a record copy along with the second element of the second ply but typically in different files (e.g. one by the customer, the other the package delivery company).

It is the primary object of the present invention to provide an improved shipping-facilitating business form, and method of utilization thereof, which minimize the amount of work necessary to get a package ready for shipping while also minimizing the possibility of mismatching address and tracking labels. This and other objects of the invention will become clear from an inspection of the detailed description of the invention and from the appended claims.

DETAILED DESCRIPTION OF THE DRAWINGS

Figure 1:
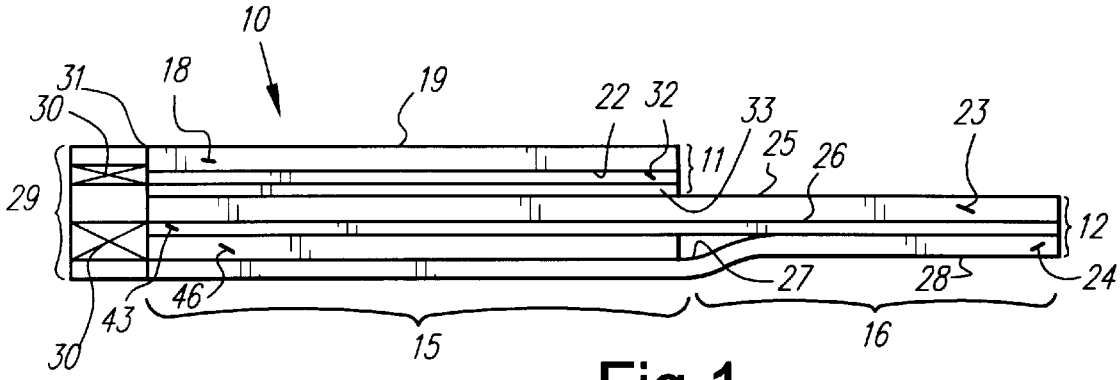
FIG. 1 is a side schematic view, with components greatly enlarged for clarity of illustration, of an exemplary shipping-facilitating business form according to the present invention.
Figure 2:
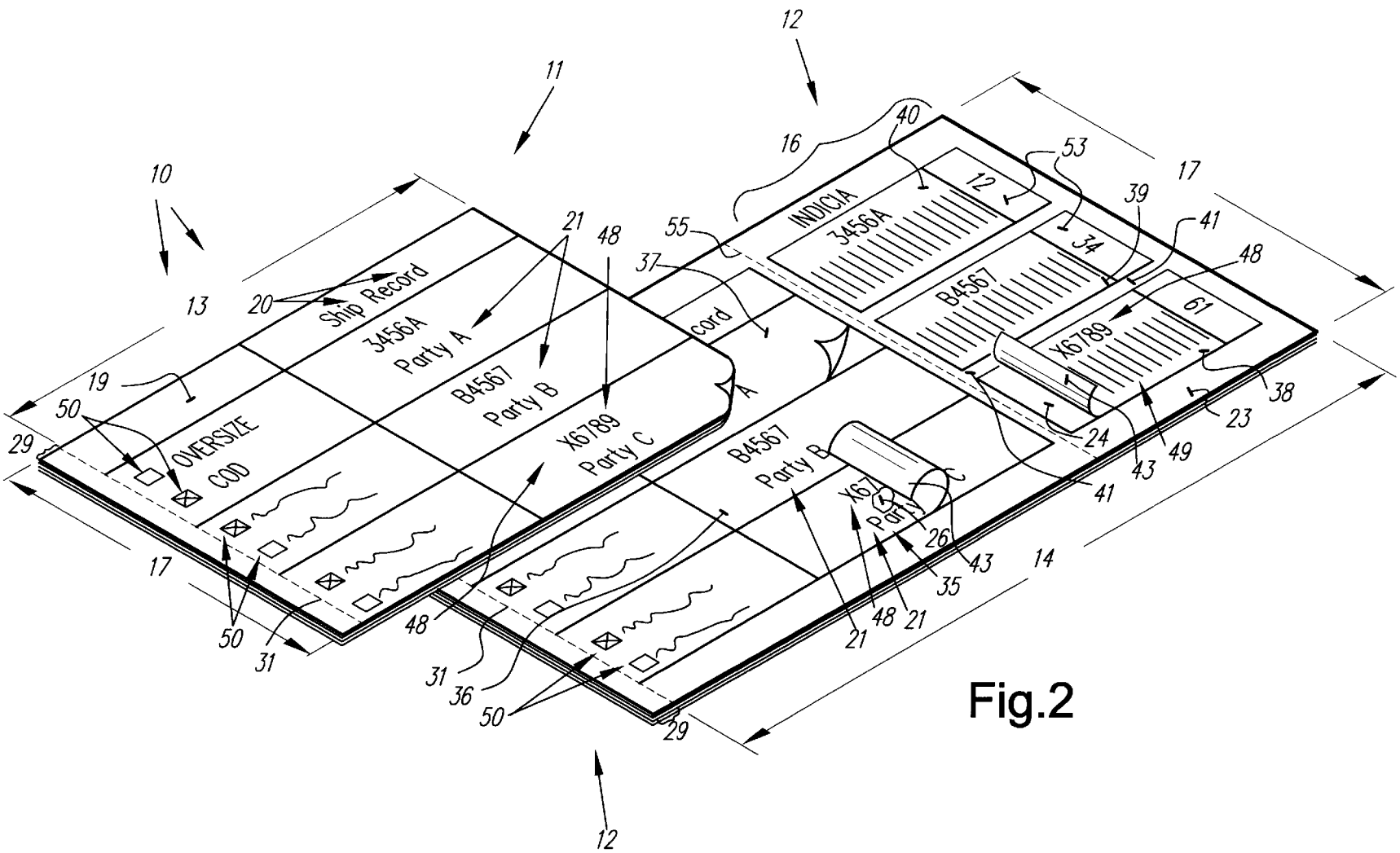
FIG. 2 is a top perspective exploded view of the form of FIG. 1 showing two of the labels thereof partially removed.

An exemplary shipping facilitating business form according to the present invention is illustrated generally by reference numeral 10 in FIGS. 1 and 2. The form 10 includes a first paper ply 11, and a second, composite, ply 12. The first ply 11 (which is the top ply during use) has a first length 13 while the second ply 12 has a second length 14 greater than the first length 13, so as to include a portion 15 overlaid by the first ply 11, and an extension portion 16 substantially uncovered by the first ply 11. The plies 11, 12 both each have substantially the same width 17 in the preferred embodiment.

The first paper ply 11 comprises a paper substrate 18 having a top face 19 which typically includes at least some non-variable indicia such as the indicia 20, illustrated in FIG. 2, and for receipt of variable indicia thereon, such as outgoing address 21 (see FIG. 2). The first paper ply substrate 18 also has a bottom face 22.

The second, composite, ply 12 comprises a first sheet element 23 such as a standard paper sheet preferably of the type commonly used for labels, and a second sheet element 24 underlying the first element 23. The second sheet element 24 comprises at least in part a conventional adhesive release liner, and in the embodiment illustrated it substantially wholly comprises an adhesive release liner.

The first element 23 has a top face 25 and a bottom face 26, while the second element 24 has a top face 27 and a bottom face 28.

The first and second plies 11, 12 are typically attached to each other (for example in a releasable manner) such as by the conventional edge structure 29, which includes adhesive—illustrated schematically at 30 in FIG. 1—for holding the plies 11, 12 together. A perforation line, or other line of weakness, such as shown schematically at 31 in FIGS. 1 and 2, may be provided to allow ready detachment of the plies 11, 12 from each other after labels (to be hereinafter described) are removed therefrom and it is desired to use the plies as record copies. Any suitable conventional structure may be used as the element 29 to hold the plies together, including mechanical fasteners, other types of adhesive, crimping of the paper forming the plies, etc.

The element 29 holds the plies 11, 12 together during use so that the first ply 11 overlies the overlaid portion 15 of the second ply 12, with the extension portion 16 of the second ply 12 extending past the length of the first ply 11 so that the extension portion 16 is substantially uncovered by the first ply 11.

The business form 10 further comprises first image transfer means operating between the first ply bottom face 22 and the overlaid portion 15 of the first element top face 25 for transferring indicia (such as the indicia 21 illustrated in FIG. 2) imaged on the first ply top face 19 to the overlaid portion 15 of the first element top face 25. The image transfer means may comprise any conventional structure performing that function, such as carbon paper, any of a wide variety of carbonless coatings, or similar coatings or structures. In the embodiment illustrated in FIGS. 1 and 2 the first image transfer means comprises a first carbonless coating 32 on the bottom face 22 of the first ply 11, and a carbonless coating 33 of the type cooperating with the coating 32 on the top face 25 on the second ply 12 overlaid portion 15. That is the first ply 11 is a CB sheet, and the first element 23 of the second ply 12 comprises a CF sheet (or a CFB sheet).

Figure 4:
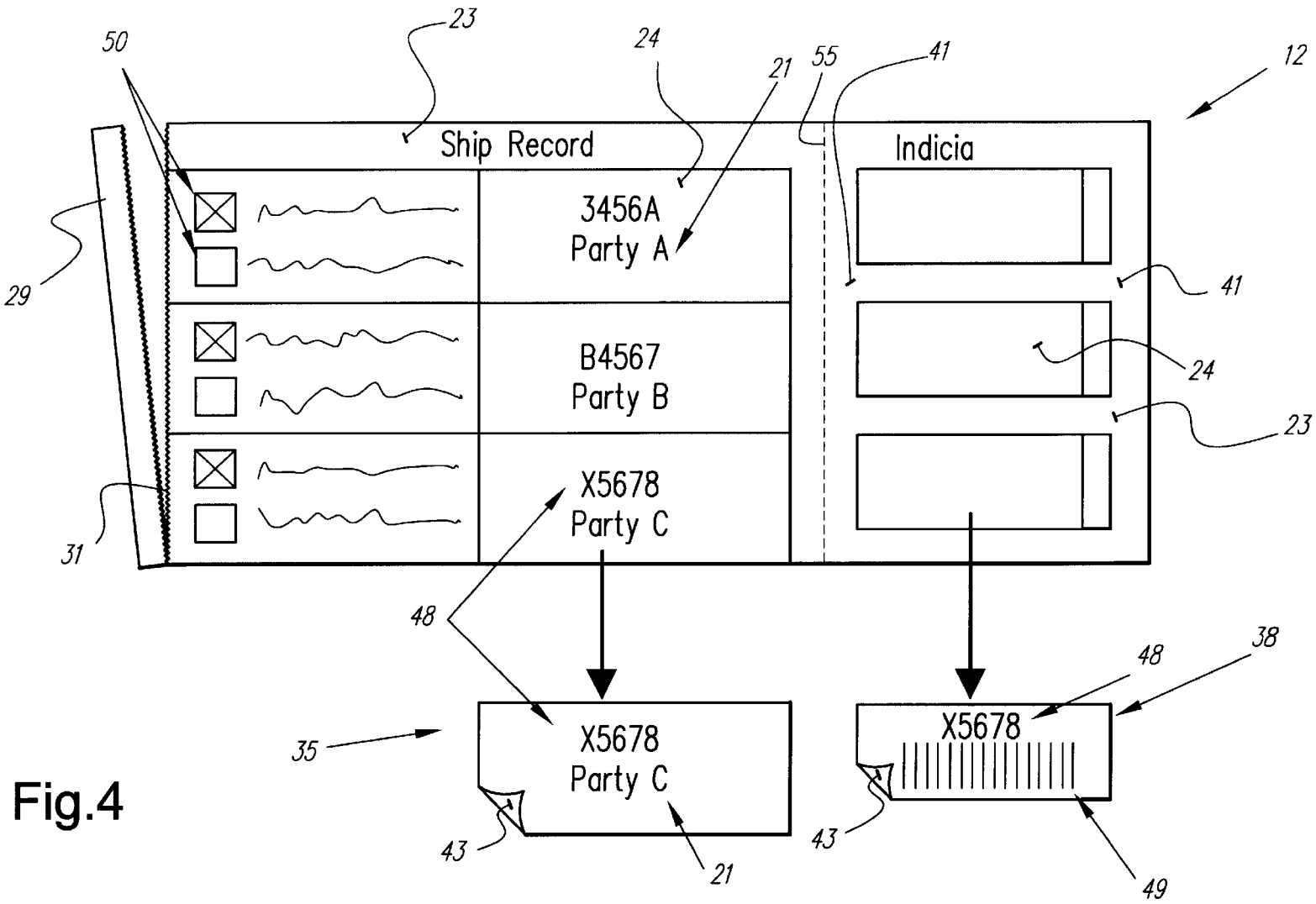
FIG. 4 is a top plan view of the second, composite, ply of the business form of FIGS. 1 and 2 after all of the labels have been removed.

A first plurality of labels is formed from said first element 23 and the overlaid portion 15 thereof. This first plurality of labels in the embodiment illustrated in the drawings is shown as three labels, 35, 36, and 37, however it is to be understood that only two labels need be provided, or four or more labels may be provided. The labels 35–37 may be formed by die-cutting the first element 23, or by any other conventional label-forming technique. A separate second plurality of labels—in the embodiment illustrated in the drawings the labels 38, 39, and 40—are formed in the extension portion 16 of the second ply 12, again by die cutting the first element sheet 23 utilizing any other conventional label-forming technique. In the preferred embodiment illustrated, each of the plurality of labels 35–37 has a corresponding label of the second plurality of labels 38–40, preferably being side-by-side therewith. That is the labels 35, 38 are side-by-side, the labels 36, 39, side-by-side, and the labels 37, 40, side-by-side. While FIGS. 2 and 4 illustrating a matrix 41 of material remaining after the labels 38–48 are die cut, it is to be understood that the labels can be formed without such a matrix 41.

The business form 10 also comprises pressure sensitive adhesive between the first and second elements 23, 24 for removably holding the first element 23 to the second element 24, but allowing removal of a label (e.g. 35–40) of the first element 23 from the second element 24 with the adhesive on the first element label. The pressure sensitive adhesive coating may be completely continuous on the bottom face of the first element 23 (as illustrated in FIG. 1), or may be discontinuous, applied only where one of the labels 35–40 is provided. The pressure sensitive adhesive is schematically illustrated at 43 in FIG. 1, and the bottom faces 26 of the labels 35, 38 in FIGS. 2 and 4 are shown with the adhesive 43 thereon. The pressure sensitive adhesive 43 may be of any suitable conventional type such as permanent, removable, or repositional, of any desired conventional chemical formulation (but matching the adhesive release properties of the second element 24 so that it readily detaches), that is suitable for application to a package, such as the package 44 in FIG. 3. Permanent pressure sensitive adhesive is preferred.

The business form 10 also comprises second image transfer means cooperating between the first element 23 bottom face 26 and the second element 24 top face 27 where overlaid by the first ply 11 (that is the overlaid portion 15—the second image transfer means may also be provided in the extension portion 16 if there is any need for it) for transferring indicia imaged on the top face 25 of the first element 23 (ultimately imaged on the first ply top face 19) to the second element top face 27, and remaining on the second element top face after removal of a label (e.g. 35) from the first element 23. The second image transfer means again may comprise any conventional image transfer coating or structure. In the exemplary embodiment illustrated in FIG. 1 is shown as a self-contained coating 46 on the top face 27 of the second element 24. Alternatively the first element 23 may be a CFB sheet, and the element 24 a CF sheet (at least in the overlaid portion 15 thereof).

Figure 3:
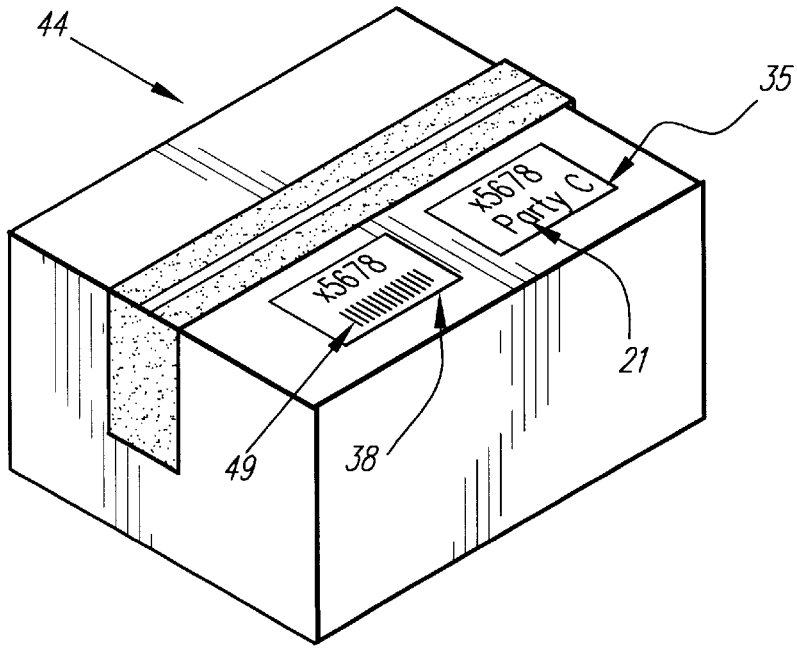
FIG. 3 is a top perspective view of a package ready for shipping utilizing labels from the business form of FIGS. 1 and 2.

The business form 10 also preferably comprises common indicia, preferably in the form of a package tracking number, on at least the corresponding labels 35, 38; 36, 39;

and 37, 40, respectively, but also preferably—as illustrated in FIGS. 2 and 4—on each portion of the first ply 10 corresponding to a label 35–37, and on the top face 27 of the second element 24 underlying that label 35–37. This common indicia (e.g. tracking number) is illustrated in FIGS. 2 and 3 for the labels 35, 38 by reference numeral 48, e.g. the number "X5678". The other labels and corresponding elements of the first ply 11 are also shown with their own individual common indicia (e.g. tracking number), such as "B4567" for the labels 36, 39, and "3456A" for the labels 37, 40. Of course any suitable characters (numbers, letters, or any other conventional characters) may be provided making up the tracking numbers 48, and in the preferred embodiment in order to greatly facilitate tracking the same tracking number (as well as perhaps other suitable information) as the number 48 is provided in machine readable (bar code) format as illustrated by reference numeral 49 in FIGS. 2 through 4. Similar bar code (with the appropriate configuration for the particular tracking numbers thereon) is also provided for the labels 39, 40, as schematically illustrated in FIG. 2.

In the utilization of the form 10, the variable indicia in the form of the addresses 21 is variably imaged, and also typically the indicia 48, 49. The variable indicia 48, 49 may be imaged at one location, and then the indicia 21 at another location, or they all may be imaged at the same location. The indicia 48, 49 are typically imaged by a suitable impact printer, although in some circumstances by a non-impact printer, and the indicia 21 may be imaged by an impact printer, by handwriting (e.g. with a ball point pen), or in other conventional manners. The form 10 may also comprise other package delivery relevant indicia imaged on the first ply top face 19 at a portion thereof not overlying the label 35–38, and transferred by the first image transfer means 32, 33 from the first ply 11 to the first element 23 top face 25 remote from, but corresponding to, a label 35–38. This other delivery relevant indicia is illustrated schematically at 50 in FIGS. 2 and 4 and typically includes a variable component (such as a box or line for checking of a particular type of delivery service, or a particular weight or configuration of the package 44 with which that entry is associated, and/or a dollar amount for shipping the package 44 associated therewith, etc.), as well as variable indicia that is imaged at the time of shipping (e.g. by checking the box "COD", by inserting a dollar amount for the shipping costs, by inserting the weight of the package 44, etc.).

The business form 10 is preferably utilized in a manner facilitating package delivery, such as by practicing the following steps:

Imaging variable address indicia 21 on the top face 19 of the first ply 11, which transfers (via the first image transfer means 32, 33) to a first label 35 of the first plurality of labels 35–37 underlying the first ply 11 (that is in portion 15 of the second ply 12).

Removing the first label 35 from the second element 24 by peeling it back (as schematically illustrated in FIG. 2) and then pressing the pressure sensitive adhesive 43 onto the package 44 (see FIG. 3) on the portion thereof on which an address label is typically provided. The package 44 may be any suitable conventional type, such as an envelope, carton, box, tube, etc.

Removing the label 38 of the second plurality of labels 38–40 corresponding to the first label 35 from the second element 24 and pressing the pressure sensitive adhesive 43 thereof onto the same package 44 (see FIG. 3) at a portion thereof where a tracking label would typically be provided.

The above steps are repeated for each label of the first and second plurality of labels (that is for the labels 36, 39 and then 37, 40) with each label of the first plurality of labels and its corresponding label from the second plurality of labels being removed from the form 10 and applied to a package 44 before any other labels are removed. That is the labels 35, 38 are removed and applied to a package 44 before any of the labels 36, 37, 39 and 40 are removed. Then the labels 36, 39 are removed and applied to a package 44 before the labels 37, 40 are removed; etc.

Retaining the second element 24 (and any part of the first element 23 still adhered thereto—see FIG. 4) as a record copy in one file, while retaining the first ply 12 as a record copy in a different file (e.g. one a record copy by the shipping company, and the other a record copy by the customer).

The common indicia typically includes bar code indicia 49 on the labels of the second plurality of labels (38–40), and the method further comprises the step of:

Using the bar code indicia 49 to track the package 44 using conventional techniques (such as scanners and software and hardware associated with the scanners).

It is to be understood that a wide variety of other modifications may be provided. For example there may be more than one label associated with each of the second plurality of labels 38, 40 such as the smaller labels 53 schematically illustrated in FIG. 2 which may be provided on a second package of a set of packages to be transmitted at the same time (such as bound together), in case there is inadvertent separation, or for any other purpose. Also perforation lines may be provided in either of the plies 11, 12, or any portion thereof, to remove portions thereof after use (for example a perforation line 55 —see FIGS. 2 and 4—between the portions 15, 16 allowing the portion 16 to be detached after the labels 38, 40 have been removed therefrom), or either of the plies 11, 12, or the elements 23, 24, may be constructed from multiple elements rather than completely integral elements as illustrated in the drawings (for example the sections 15, 16 of the second element 24 may be separable elements held together by an adhesive strip).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A shipping facilitating business form comprising:

a first paper ply comprising a top face containing non-variable indicia and for receipt of variable indicia thereon, and a bottom face, and having a first length;

a second, composite, ply having a first sheet element, and a second sheet element underlying said first element, each element having a top face and a bottom face, and said second ply having a second length, greater than said first length;

said first ply overlying said second ply with said bottom face of said first ply contacting said top face of said first element at an overlaid portion of said second ply, and with an extension portion of said second ply extending past the length of said first ply so that said extension portion of said first element of said second ply is substantially uncovered by said first ply;

first image transfer means operating between said first ply bottom face and said overlaid portion of said first element top face for transferring indicia imaged on said first ply top face to said overlaid portion of said first element top face;

said second sheet element comprising at least in part an adhesive release liner;

a first plurality of labels formed from said first element in said overlaid portion thereof and, and a separate second plurality of labels formed in said extension portion thereof;

pressure sensitive adhesive between said first and second elements for removably holding said first element to said second element, but allowing removal of a label of said first element from said second element with said adhesive on said first element label; and second image transfer means operating between said first element bottom face and said second element top face where overlaid by said first ply for transferring indicia imaged on said first ply top face to said second element top face and remaining on said second element top face after removal of a label of said first element.

2. A business form as recited in claim 1 wherein each of said first plurality of labels corresponds to a remaining portion of said first element and to one of said second plurality of labels; and further comprising common indicia imaged on each of said first plurality of labels and its corresponding label of said second plurality of labels, and on said first element on a remaining portion thereof corresponding to said label of said first plurality of labels.

3. A business form as recited in claim 2 wherein said first ply has corresponding portions to each of said first element plurality of labels; and wherein said common indicia is also provided on said corresponding portions of said first ply.

4. A business form as recited in claim 3 wherein said common indicia comprises a tracking number.

5. A business form as recited in claim 4 wherein said tracking number is provided on said top face of each of said second plurality of labels in at least bar code form; and wherein each label of said first plurality of labels is side-by-side with its corresponding label of said second plurality of labels.

6. A business form as recited in claim 5 wherein said second element is substantially wholly a release liner.

7. A business form as recited in claim 4 further comprising variable address indicia imaged on said first ply top face, and transferred by said first and second image transfer means to a label of said first element top face, and said second element top face underlying said label.

8. A business form as recited in claim 7 further comprising other package delivery relevant indicia imaged on said first ply top face at a portion thereof not overlying a label, and transferred by said first image transfer means between said first ply and said first element top face remote from, but corresponding to, a label of said first plurality of labels.

9. A business form as recited in claim 8 wherein said first and second image transfer means comprise a CB first ply and a CFB first element of said second ply, and a CF second element of said second ply.

10. A business form as recited in claim 2 wherein said first image transfer means comprises a CB first ply and a CF first element of said second ply.

11. A business form as recited in claim 10 wherein said second image transfer means comprises a self-contained coating on said second element top face.

12. A business form as recited in claim 2 wherein each label of said first plurality of labels is side-by-side with its corresponding label of said second plurality of labels and further comprising variable address indicia imaged on said first ply top face, and transferred by said first and second image transfer means to a label of said first element top face, and said second element top face underlying said label.

13. A business form as recited in claim 12 further comprising other package delivery relevant indicia imaged on said first ply top face at a portion thereof not overlying a label, and transferred by said first image transfer means from said first ply to said first element top face remote from, but corresponding to, a label of said first plurality of labels.

14. A method of using a business form as recited in claim 2 comprising the steps of: (a) imaging variable address indicia on the top face of the first ply which transfers to a first label of the first plurality of labels underlying the first ply; (b) removing the first label from the second element and pressing the pressure sensitive adhesive on the bottom face thereof onto a package; (c) removing the label of the second plurality of labels corresponding to the first label from the second element and pressing the pressure sensitive adhesive thereof onto the same package as in (b); and (d) retaining the second element as a record copy.

15. A method as recited in claim 14 wherein (a)–(c) are repeated for each label of the first and second plurality of labels, with each label of the first plurality of labels and its corresponding label from the second plurality of labels being removed from the form and applied to a package before any other labels are removed.

16. A method as recited in claim 14 wherein the common indicia includes bar code indicia on the labels of the second plurality of labels; and further comprising the step of using the bar code indicia to track the package.

17. A method as recited in claim 14 further comprising the step of also retaining the first ply as a record copy, in a different file than the second element record copy.

18. A business form as recited in claim 1 wherein said second element is substantially wholly a release liner.

19. A business form as recited in claim 1 further comprising variable address indicia imaged on said first ply top face, and transferred by said first and second image transfer means to a label of said first element top face, and said second element top face underlying said label.

20. A business form as recited in claim 19 further comprising other package delivery relevant indicia imaged on said first ply top face at a portion thereof not overlying a label, and transferred by said first image transfer means between said first ply and said first element top face remote from, but corresponding to, a label of said first plurality of labels.

* * * * *